United States Patent [19]

Salomon

[11] 4,042,257

[45] Aug. 16, 1977

[54] SKI BINDING

[75] Inventor: Georges Pierre Joseph Salomon, Annecy, France

[73] Assignee: Establissements Francois Salomon et Fils, Annecy, France

[21] Appl. No.: 689,200

[22] Filed: May 24, 1976

Related U.S. Application Data

[63] Continuation-in-part of Ser. No. 607,615, Aug. 25, 1975, Pat. No. 3,988,841, said Ser. No. 611,419.

[30] Foreign Application Priority Data

May 22, 1975 France ..... 75.15967

[51] Int. Cl.[2] ..... A63C 9/08

[52] U.S. Cl. ..... 280/624; 36/117

[58] Field of Search ..... 280/624, 625, 615, 614, 280/613, 611, 635; 36/117, 118, 119, 120, 121, 122, 123, 124, 125

[56] References Cited

U.S. PATENT DOCUMENTS

| | | | |
|---|---|---|---|
| 1,845,588 | 2/1932 | Durmer | 280/615 |
| 2,022,580 | 11/1935 | Utterstrom | 280/615 |
| 2,173,846 | 9/1939 | Kelley | 280/625 |
| 3,578,349 | 5/1971 | Edmund | 280/624 |
| 3,606,370 | 9/1971 | Spademan | 280/624 |
| 3,824,713 | 7/1974 | Vaccari | 36/117 |
| 3,852,896 | 12/1974 | Pyzel et al. | 36/120 X |
| 3,891,227 | 6/1975 | Spademan | 280/624 |
| 3,988,841 | 11/1976 | Salomon | 36/117 |

FOREIGN PATENT DOCUMENTS

| | | | |
|---|---|---|---|
| 2,134,357 | 8/1972 | France | 280/624 |

*Primary Examiner*—Philip Goodman
*Assistant Examiner*—Milton L. Smith

[57] ABSTRACT

The binding is specially designed to keep the boot attached to the ski by its sides and comprises a baseplate mounted on the ski, two hinged arms, each consisting of a jaw holding the boot and a resilient element urging the jaws of the hinged arms towards the lateral edges of the boot. The jaws carry at one end a first ramp and, at the other end, a second ramp. Each lateral edge of the boot has a first ramp and a second ramp. The binding is intended, more particularly, to keep the boot attached to the ski, without any play, even if there is snow under the sole of the boot.

15 Claims, 7 Drawing Figures

SKI BINDING

This application is a continuation-in-part of applicant's copending Applications Serial No. 607,615 filed Aug. 25, 1975 and now U.S. Pat. No. 3,988,841 issued Nov. 2, 1976 and Serial No. 611,419 filed Sept. 8, 1975.

The invention relates to a safety binding for a ski boot and, more particularly, to a binding consisting of two hinged arms each comprising a jaw co-operating with the lateral edge of the boot.

Bindings designed to hold the boot to the ski by its sides are known; they have the notable advantage of not impeding the boot in any way after a release, so that the boot may continue to advance in the longitudinal direction of the ski; for example, U.S. Pat. No. 3,578,349 to EDMUND and French Pat. No. 2,134,357 to SPADEMAN disclose bindings of this type.

Existing bindings of this type, however, have various disadvantages.

In the first place, it will be observed that the release mechanisms are not precisely defined, i.e. the support zones and sliding zones between the jaws vary at random, especially as a function of the wedge of compacted snow sticking to the sole of the boot. This means that the binding is not reliable, since it releases differently, depending upon the circumstances. This applies particularly to the above SPADEMAN binding, in which the jaws of the levers (or arms) are moved, in the plane of the ski, against the lateral edges of the boot; from the drawings and specification of the SPADEMAN patent, it is clear that the areas of contact between the female surfaces of the levers and the male surface surfaces of the locking cheeks of the stirrup, integral with the ski, vary in accordance with the slope of the boot and the vertical position thereof in relation to the ski.

This also applies to the above EDMUND binding, where a wedge of snow under the sole of the boot causes play in the longitudinal position thereof.

In the second place, it will be observed that lateral or longitudinal release is effected against the weight of the skier in the case of the EDMUND binding mentioned above. Actually, the boot must lift in relation to the ski, in order to allow the boot to escape from the jaws by passing above knurled wheels. A release of this kind is unsafe, since it is inadmissible that the forced required to release the binding be a function of the skier's apparent weight.

In the third place, moreover, the jaw according to EDMUND also has another disadvantage, in that it cannot release if the skier falls backwards.

Thus the safety bindings known at present and designed to secure the boot to the ski by its sides have no means of ensuring reliable release of the binding under all circumstances, especially if there is a wedge of snow under the boot.

It is an object of this present invention to provide a safety binding which secures the boot to the ski by its sides; this is achieved by means of a jaw, the structure of which is such that:

on the one hand, the binding releases in the same way under any circumstances, even if there is a wedge of snow under the sole of the boot, and on the other hand:

the boot is held without play, even if there is snow under the sole;

there is no need for the boot to lift in relation to the ski in order to achieve lateral or longitudinal release;

the binding releases in the event of a backward fall.

In order to obtain this result, the binding according to the invention comprises:

a baseplate mounted upon the ski, two arms hinged in relation to the baseplate, arranged symmetrically in relation to the longitudinal axis of the ski;

each comprising a boot-holding jaw co-operating with the lateral edge of the boot, a resilient element which is mounted upon the baseplate and which actuates the hinged arms, causing them to bear against the lateral edges of the boot.

Furthermore, according to one main characteristic of the invention:

each of the jaws comprises:

at one end a first ramp substantially parallel with the plane of the ski, at an angle to the longitudinal axis of the ski, at the other end a second ramp located substantially in a vertical plane;

each of the lateral edges of the boot comprises:

a first ramp at an angle to the plane of support of the sole of the boot upon the baseplate, a second ramp substantially perpendicular to the plane of support of the sole of the boot upon the baseplate.

The first ramps of the jaw and the boot co-operate with each other, under the action of the resilient element, in such a manner that the second ramp of the boot is caused to bear against the second ramp of the jaw.

As a result of this arrangement, the kinematics of the movement of the boot in relation to the jaw are very precisely defined. Thus in the event of a lateral movement, one of the second ramps of the boot is in contact — with almost no relative movement — with the corresponding second ramp of the jaw; this contact constitutes a center of rotation for the boot; at the same time, the first ramps of the jaw and the boot, located on the side facing the center of rotation, are in sliding point-contact by reason of their inclination.

According to one complementary characteristic of the invention, the first ramp of the jaw preferably terminates in a release nose.

Moreover, the first ramp of the jaw is also preferably at an angle to the longitudinal axis of the binding and to the second ramp of the jaw.

According to another complementary characteristic of the invention, it is desirable for the first ramp of the boot to be located substantially in a vertical plane in relation to the plane of support of the sole of the boot upon the baseplate; the vertical plane, in which the first ramp of the boot is located, is substantially parallel with the longitudinal axis of the boot. In this case, the first ramp of the boot slopes from top to bottom towards the second ramp of the boot.

Bearing in mind the respective inclinations of the first ramps of the jaw and of the boot, the presence of a wedge of snow under the sole of the boot does not cause play in the longitudinal position of the boot upon the ski. Contact between the jaw and the boot is always through the second ramps of the jaw and of the boot.

Preferably, and according to still another complementary characteristic of the invention, the first and second ramps of the boot are arranged in lateral recesses in the boot in which the jaw engages; these lateral recesses may form a channel crossing from one side of the boot to the other, the straight section of the channel being trapezoidal.

As a result of this arrangement, the ramps integral with the boot are located entirely within the volume of the boot and do not project therebeyond; for this reason, there is less risk of the skier damaging the ramps by walking upon rocky ground; moreover, should the skier stumble, there is no danger of him injuring himself or other persons with any projecting piece of metal fitted under the sole of the boot.

Preferably, and according to still another complementary characteristic of the invention, the second ramp of the jaw slopes from bottom to top towards the longitudinal plane of symmetry of the ski. This second ramp of the jaw ends in a release nose, the release nose of the first ramp of the jaw, and the release nose of the second ramp of the jaw being located in the same plane parallel with the horizontal plane of the ski; still more particularly in this case, the edge connecting the release nose of the first ramp of the jaw, and the release nose of the second ramp of the jaw, is located in a plane substantially perpendicular to the plane of the ski, and forming, with the longitudinal axis of the boot, an angle substantially equal to the opening angle of the hinged arms at the time of release.

As a result of this arrangement, and especially in the event of a backward fall, the boot escapes from the jaw at the same time at all points of contact between the jaw and the boot.

In the case of certain variants of the invention, and according to another complementary characteristic thereof, the jaw comprises a third ramp running from the release nose of the first ramp of the jaw and extending towards the arm from the interior to the exterior of the ski.

This third ramp of the jaw, in conjunction with the first ramp of the boot, prevents the boot from pivoting about its longitudinal axis, and the foot is thus held more securely.

The edges of the ramps are preferably straight lines.

A description will now be given, non-restrictively and merely by way of example, of a few examples of embodiment of the binding according to the invention, with reference to the drawing attached hereto, wherein.

Figure 1:
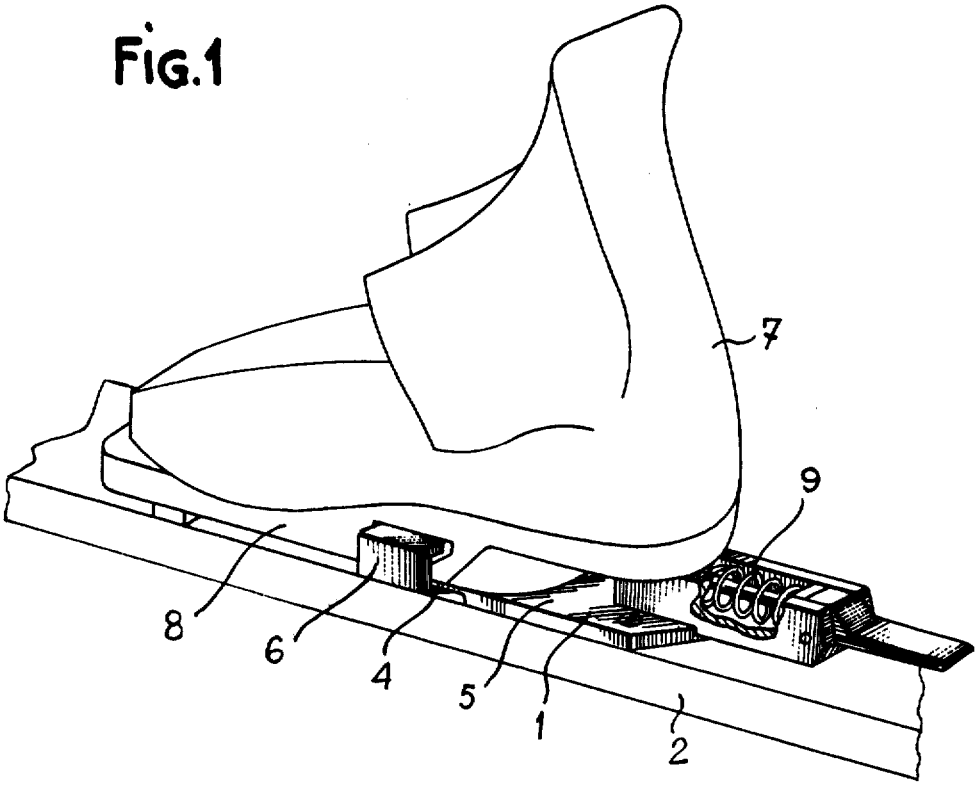
FIG. 1 is a cut-away perspective view of a binding according to the invention, showing the boot and the resilient element which applies the hinged arms to the boot.

Referring to FIG. 1, binding 1 is held to ski 2 by means of screws and a baseplate 3. The binding consists essentially of two arms hinged in relation to baseplate 3, one arm 4 being clearly visible in the figure. These arms are arranged symmetrically in relation to longitudinal axis of symmetry 5 of the ski (this will be better understood by referring to FIG. 4 and to the description of this figure); each arm comprises a retaining jaw 6 for boot 7 which runs above baseplate 3 and co-operates with lateral edge 8 of the boot. A resilient element 9, mounted upon the baseplate, causes the jaws of the hinged arms to bear against the lateral edges of the boot.

Figure 2:
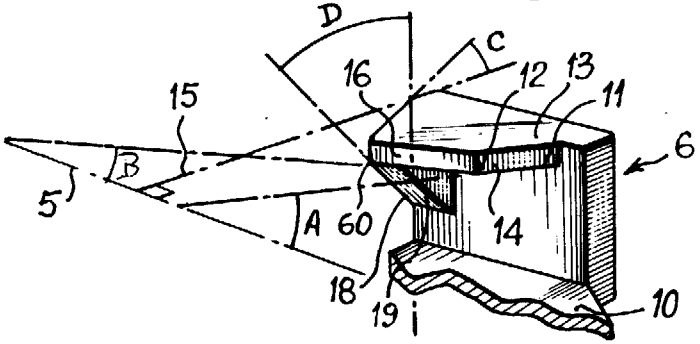
FIG. 2 shows, in perspective, a detail of one of the jaws of the binding illustrated in FIG. 1.

FIG. 2 shows, in perspective, a detail of one of the jaws illustrated in FIG. 1 (the jaw located on the right-hand side of the boot).

The jaw is carried upon an arm 10 of which only the end is visible. This jaw comprises a ramp consisting of a straight edge 11 substantially parallel with the plane of the ski; when at rest, ramp 11 is at an angle A to the longitudinal direction of the ski, and it slopes towards the longitudinal axis of the binding and towards a second ramp 18 of the jaw. First ramp 11 of the jaw ends in a release nose 12. Edge 11 is the lower edge of a substantially horizontal shoulder 13 integral with arm 10. Edge 14 of shoulder 13 is substantially vertical and is extended beyond release nose 12 by means of a substantially vertical surface 16; this surface slopes from the back to the front of the binding, towards the longitudinal axis of symmetry thereof. Front face 17 of the jaw (not visible in FIG. 2, but visible in FIG. 6) is substantially flat and vertical; when at rest, it is at an angle C to transverse direction 15 of the ski; this relief angle C prevents engagement of the boot and jaw when the binding opens, more particularly during release in the event of a forward or backward fall. Front face 17 of the jaw comprises a ramp, known as the second ramp of the jaw, consisting of an edge 18; second ramp 18 of the jaw, located substantially in a vertical plane, slopes from bottom to top towards the longitudinal plane of symmetry of the binding, and forms an angle D with a direction at right angles to the plane of the ski; it also ends in a release nose 60. This edge 18 is extended towards the rear of the binding by a sloping surface 19 which is at the same angle to the vertical as ramp 18; surface 19 runs between a part of surface 16 of shoulder B and the lower part of the jaw. The lower edge of surface 16 unites release nose 12 and release nose 60; the slope B of the lower edge of this surface, in relation to longitudinal axis 5 of the ski, is substantially equal to the opening angle of the hinged arms, which allows the boot to escape from the jaw simultaneously at all points of contact between the jaw and the boot, especially in the event of a release caused by a fall forwards or backwards.

Figure 4:
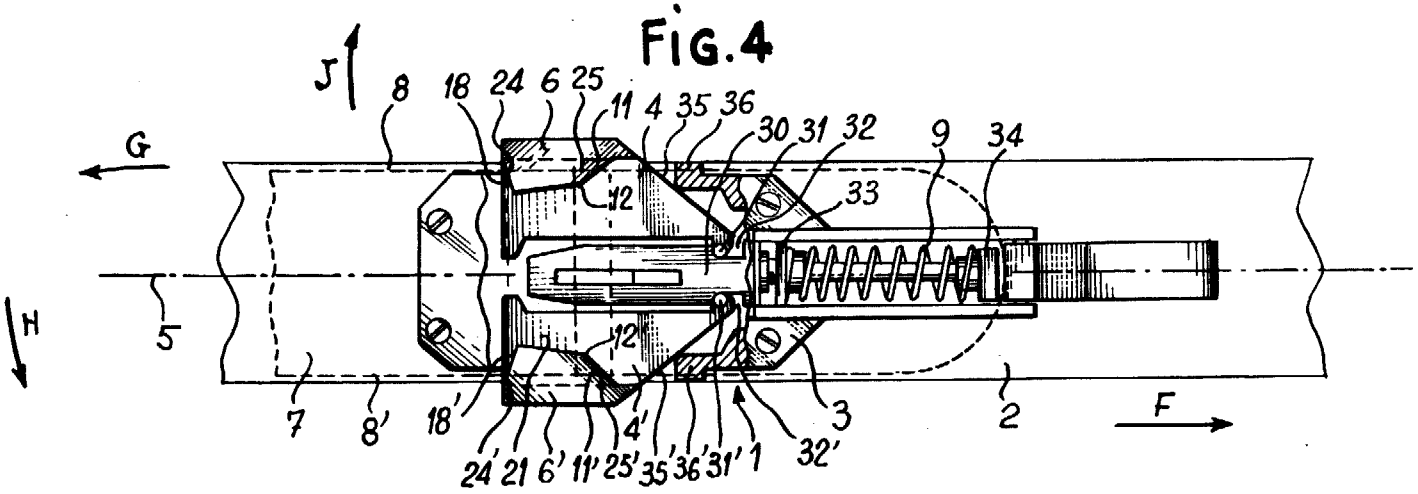
FIG. 4 is a plan view of the binding illustrated in FIG. 1, with the boot in position (the boot and the housing of the binding being assumed to be transparent)

Face 17, and especially edge 18, of the jaw serve to support the boot, especially when the latter pivots under the action of a lateral load; this will be better understood when the functioning of the binding under a lateral load is described in conjunction with FIG. 4.

Figure 3:
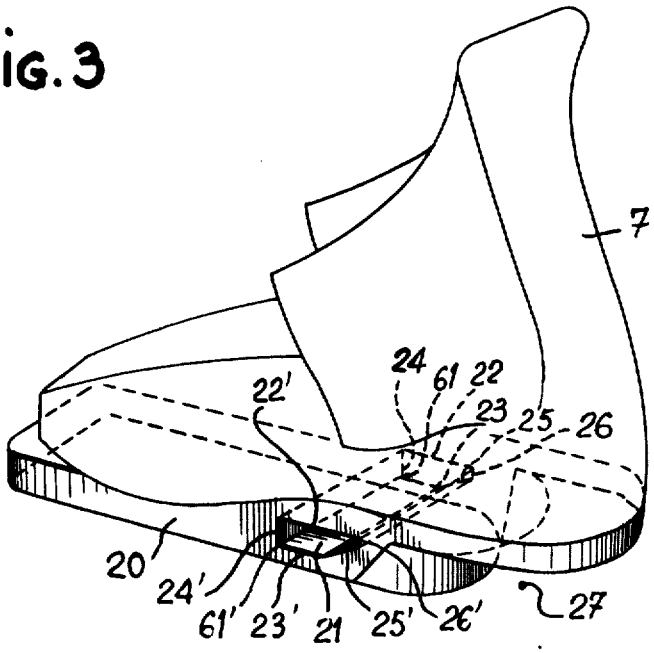
FIG. 3 shows, in perspective, the recess in the boot illustrated in FIG. 1.

As shown in FIG. 3, sole 20 of the boot has a transverse recess 21 running from one side of the boot to the other. This prismatic recess is of substantially trapezoidal cross section, with major base 22 at the top and minor base 23 at the bottom. One of the sides 24, that located towards the front of the boot, is substantially vertical, whereas the other side 25, located towards the rear, slopes and is united with the major base by a substantially vertical part 26.

Edges 24 and 24' are substantially vertical, are located at the edges of the sole, and constitute the ramps identified above as second ramps of the boot; they are designed to cooperate with front face 17 of the jaw, more particularly with edge 18.

Sloping edges 25,25', located at the edges of the sole of the boot, constitute the ramps identified above as first ramps of the boot; they are designed to co-operate with first ramps, such as first ramps 11 of the jaws.

Edges 23 and 23' constituting the minor bases of the trapezoid or, to be more specific, the points of convergence 1 and 1' (61 and 61') of edges 23,23' and edges 24,24', cooperate with second ramps of the jaws, especially in the case of a release due to a backward fall.

Rear portion 27 of the sole of the boot is cut away and hollowed out at the location of the heel, as disclosed in French Patent Application No. 74 29616, for the purpose of preventing the boot becoming jammed in the binding at the end of a lateral release.

In conjunction with FIG. 4, a description will now be given of the way in which the ramps integral with the boot and jaws co-operate with each other. In order to make the drawings more easily understood, it is assumed that the boot and the housing enclosing the binding are transparent. The elements described in conjunction with FIGS. 1, 2 and 3 also appear in FIG. 4, namely: ski 2, binding 1, baseplate 3, hinged arms 4,4', jaws 6,6', and resilient element 9 causing the jaws to bear against the boot. Also shown in FIG. 4 is the way in which arms 4,4' are hinged, in relation to an elongated slide 30, by means of two vertical axes 31,31' integral with arms 4,4' supported in two housings 32,32' of slide 30. The latter is displaceable along the longitudinal axis 5 of the ski, and is actuated by a resilient element 9, one end of which bears against a shoulder 33 integral with baseplate 3, while the other end bears against curved end 34 of slide 30. Lateral edges 35,35' of hinged arms 4,4' bear against vertical edges 36,36' of baseplate 3. It may easily be gathered from FIG. 4 that a rearward displacement of slide 30, in the direction of arrow F, produced by resilient element 9, tends to move jaws 6,6' towards lateral edges 8,8' of boot 7 (the boot, assumed to be transparent, is shown in dotted lines, in order to make it more easily distinguishable from the elements constituting the binding).

Jaws 6,6' enter, from each side of the boot, recess 21 which runs from one side of the sole of the boot to the other.

It will be observed that first ramps 11,11' of jaw 6,6' are in point-contact with first ramps 25,25' of the boot. The effect of the respective slopes of these ramps is to push the boot downwardly and to the rear, in other words the boot is pressed against baseplate 3. Second ramps 24,24' of the boot bear against front faces 17,17' of the jaws, and against second ramps 18,18' of the jaws; in this position, the boot can no longer move backwards, and is thus held in position upon the ski.

A description will now be given of the functioning of the binding in the event of a lateral release, for example a release to the left. The boot is caused to bear against second left-hand ramp 18 of the jaw by second ramp 24' located on the left-hand side of the boot. The point contact between the left-hand ramps provides a centre about which the boot rotates on left-hand jaw 6', the boot pivoting in the direction of arrow H. However, because of the thickness of the parts, the jaw-boot contact is linear, and thus constitutes an almost vertical axis of rotation.

At the same time, first right-hand ramp 25 of the boot slides along first right-hand ramp 11 of the jaw, thus pushing it back. The slope of first ramp 11 of the jaw is such that first ramp 25 of the boot causes arm 4 to rotate in the direction of arrow J, against the action of the resilient element.

As soon as first ramp 25 of the boot clears release nose 12 of first ramp 11 of the jaw, the boot escapes freely from the binding.

A description will now be given of the functioning of the binding under the action of a longitudinal load causing the boot to advance in the direction of arrow G.

First ramps 25,25', integral with the boot, separate jaws 6,6' laterally as they slide along ramps 11,11'; this movement takes place against the action of resilient element 9. When ramps 25,25' clear release nose 12,12', the jaws are open at an angle equal to angle B. As a result of this, faces 16,16' of the jaws become parallel with the longitudinal axis of the ski, and the boot may therefore advance freely upon the longitudinal axis of the ski.

Figure 5:
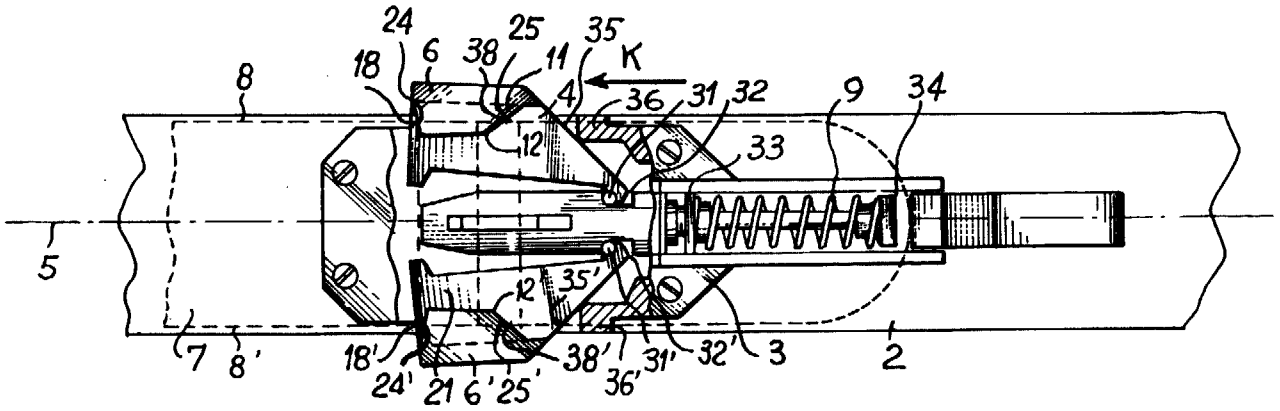
FIG. 5 is a plan view of the binding illustrated in FIG. 1, with the boot in position (the boot and the housing of the binding being assumed to be transparent), in the case in which the boot has a wedge of snow under the sole.

A description will now be given of the effect of a wedge of snow, in conjunction with FIG. 5, in which the boot and the housing of the binding are assumed to be transparent, in order to reveal the relative positions of the elements constituting the said binding, especially of the jaws. Most of the elements described in conjunction with FIG. 4 appear in FIG. 5, and they bear the same reference numerals. The effect of a wedge of snow is to lift the boot, whereupon first ramps 11,11' of the jaw are caused to bear, at different points, upon first ramps 25,25' integral with the boot; on first ramps 11,11' of the jaw, support points 38,38' will be closer to release noses 12,12'; on first ramps 25,25' of the boot, support points 38,38' will be closer to minor bases 23,23' of the trapezoid. In order that contact points 38,38' between ramps 25,25' and 11,11' may move forward in the direction of arrow K, the jaws must move away from the edges of the sole of the boot. Thus a wedge of snow under the sole of the boot will have the effect of separating the jaws slightly, which may be seen by comparing FIGS. 4 and 5 - in FIG. 5, the jaws are farther apart than in FIG. 4. The presence of a wedge of snow has no other effect upon the functioning of the binding, and, due to second ramps 24,24' of the boot and 18,18' of the jaw, the longitudinal position of the boot remains practically unchanged.

Figure 6:
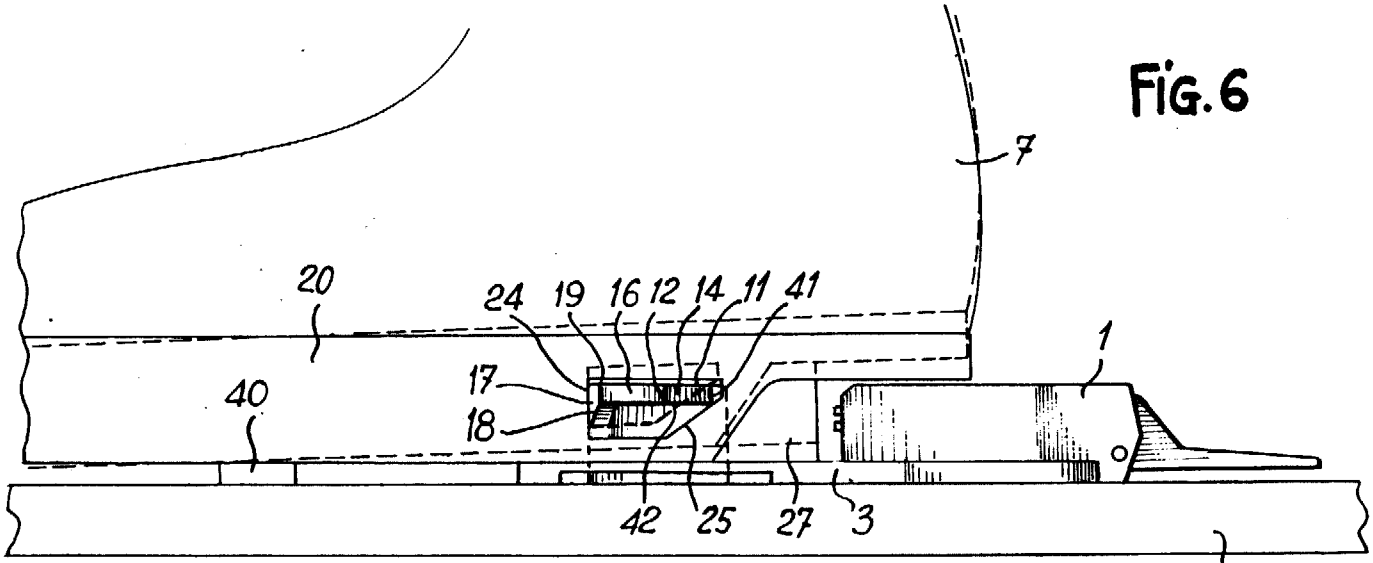
FIG. 6 is a side elevation of the binding illustrated in FIG. 1 during vertical release (with the jaw in the foreground omitted in order to show the relative positions of the boot and jaw ramps)

A description will now be given of a vertical release of the binding, in conjunction with FIG. 6. Most of the elements already described appear in this figure, bearing the same reference numerals. Also shown in this figure is an antifriction plate 40 secured to the ski under the front end of the sole of the boot, in order to allow the boot to slide freely in the longitudinal direction.

In the event of a vertical release, the boot bears upon anti-friction plate 40. First ramps 11,11' and 25,25' of the two jaws and of the boot slide simultaneously one upon the other in the manner of scissors. Similarly, ramps 18,18' and 24,24' of the two jaws and the boot slide simultaneously one upon the other; these latter ramps serve to keep the boot in the same longitudinal position against the action of first ramps 11,11' of the jaws, which tend to pull the boot backwards.

When a support point 41 of first ramps 11,11' of the jaws, upon first ramps 25,25' of the boot, clears the release nose 12, the boot escapes freely from the binding.

The position assumed by the boot during a vertical release is shown in dotted lines; the rear of the boot is lifted; the point of support between first ramps 11 and 25 (the only ones visible in the figure) has moved forward to 42.

A description will now be given of the release of the binding in the event of a fall in the backward direction. The heel of the boot rests upon the binding; points of convergence 61,61' of edges 24,24' and 23,23' slide from bottom to top along second ramps 18,18' of the two jaws; first ramps 11,11' and 25,25' of the jaws and the boot slide simultaneously one upon the other, serving to stabilize the boot, especially in its longitudinal position upon the ski. When contact points 61,61' between second ramps 18,18' of the jaw and second ramps 24,24' of the boot clear the release noses 60 of the second ramps of the jaws, the boot is freely released.

It will be noted that in the event of a purely vertical release, the first ramps of the jaw and the boot, on the one hand, and the second ramps of the jaw and the boot, on the other hand, slide simultaneously upon the two jaws. (Edges 23,23' move parallel with the ski from bottom to top); since the angle of inclination B of the edge joining release noses 60 and 12 is substantially equal to the opening angle of the hinged arms, the first ramps and the second ramps arrive practically simultaneously at their release noses 12 and 60, which is desirable.

A description will now be given of a transverse release of the binding. One of the sides of the boot, preferably the longitudinal edge of the sole, rests upon the ski or upon the baseplate of the binding; on the other side, the first ramps of the jaws and the boot slide one upon the other like the blades of a pair of scissors; simultaneously, point 61 (the point of convergence of the second ramps of the boot and of the lower edge of the trapezoidal recess in the boot) slides from bottom to top along the second ramp of the jaw. When point 61 clears release nose 60, the first ramp of the boot clears, almost simultaneously, release nose 12 of the first ramp of the jaw; whereupon the boot may escape easily from the binding.

Figure 7:
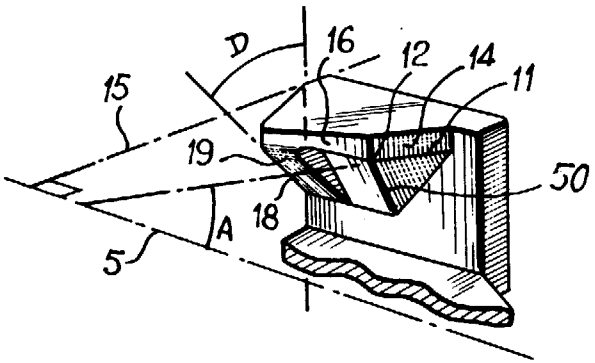
FIG. 7 shows, in perspective, a detail of a variant other than that illustrated in FIG. 2, of a jaw specially designed to prevent the boot from pivoting about its longitudinal axis.

FIG. 7 shows another variant of the jaws. The jaw in this variant has ramps which are the same as those described in connection with the jaw shown in FIG. 2, and they bear the same reference numerals. The jaw illustrated in FIG. 7 also has another ramp 50 running downwardly from release nose 12; this third ramp, which slopes from the top to the bottom of the interior, and towards the exterior of the binding, is intended to hold the foot more securely against the loads arising when the boot pivots about its longitudinal axis.

What is claimed is:

1. A safety binding for a ski boot comprising:
a baseplate mounted upon a ski,
two arms hinged in relation to said baseplate,
arranged symmetrically in relation to the longitudinal axis of said ski;
each comprising a boot-holding jaw co-operating with lateral edges of said boot,
a resilient element mounted upon said baseplate actuating said hinged arms, causing them to bear against said lateral edges of said boot;
each of the jaws comprising:
at one end a first ramp
substantially parallel with the plane of said ski,
at an angle to the longitudinal axis of said ski,
at the other end a second ramp
located substantially in a vertical plane,
each of said lateral edges of said boot comprising:
a first ramp
at an angle to the plane of support of the sole of the boot upon said baseplate,
a second ramp
substantially perpendicular to the plane of support of the sole of the boot upon said baseplate,
said first ramps of the jaw and the boot co-operating with each other under the action of said resilient element in such a manner as to apply the second ramp of the boot against the second ramp of the jaw.

2. A binding according to claim 1, characterized in that said first ramp of the jaw ends in a release nose.

3. A binding according to claim 2, wherein the second ramp of the jaw slopes from bottom to top towards the longitudinal plane of symmetry of the binding and ends in a release nose.

4. A binding according to claim 3, wherein the release nose of the first ramp of the jaw, and the release nose of the second ramp of the jaw, are located in the same plane parallel with the horizontal plane of the ski.

5. A binding according to claim 3, wherein the edge joining the release nose of the first ramp of the jaw and the release nose of the second ramp of the jaw is located in a plane substantially perpendicular to the plane of the ski, forming with the longitudinal axis of the boot an angle substantially equal to the opening angle of the hinged arms at the time of the release.

6. A binding according to claim 2, wherein the jaw comprises a third ramp running from the release nose of the first ramp of the jaw and extending towards the arm from the inside to the outside of the ski.

7. A binding according to claim 2, characterized in that said first ramp of the jaw slopes towards the longitudinal axis of the binding and towards the second ramp of the jaw.

8. A binding according to claim 1, wherein said first ramp of said boot is located substantially in a vertical plane in relation to the plane of support of the sole of the boot upon said baseplate.

9. A binding according to claim 8, wherein the vertical plane in which the first ramp of the boot is located is substantially parallel with the longitudinal axis of the boot.

10. A binding according to claim 9, wherein said first ramp of the boot slopes from top to bottom towards the second ramp of the boot.

11. A binding according to claim 1, wherein the first and second ramps of the boot are arranged in lateral recesses in the boot in which the jaw engages.

12. A binding according to claim 11, wherein the lateral recesses in the boot constitute a passage passing through the sole of the boot from one side to the other and having a substantially straight trapezoidal section.

13. A binding according to claim 1, wherein the second ramp of the jaw slopes from bottom to top towards the longitudinal plane of symmetry of the binding.

14. A binding according to claim 13, wherein the second ramp of the jaw ends in a release nose.

15. A binding according to claim 1, wherein the ramps are straight edges.

* * * * *